US010218104B2

(12) United States Patent
Mukuno et al.

(10) Patent No.: US 10,218,104 B2
(45) Date of Patent: Feb. 26, 2019

(54) CONNECTOR WITH A SPRING TERMINAL ENSURING RELIABLE CONNECTION TO A MATING TERMINAL

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Junichi Mukuno, Mie (JP); Kenichi Kitaoka, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 15/735,237

(22) PCT Filed: May 30, 2016

(86) PCT No.: PCT/JP2016/065849
§ 371 (c)(1),
(2) Date: Dec. 11, 2017

(87) PCT Pub. No.: WO2016/203934
PCT Pub. Date: Dec. 22, 2016

(65) Prior Publication Data

US 2018/0183166 A1 Jun. 28, 2018

(30) Foreign Application Priority Data

Jun. 18, 2015 (JP) ..... 2015-122669

(51) Int. Cl.
*H01R 13/15* (2006.01)
*H01R 13/24* (2006.01)
(Continued)

(52) U.S. Cl.
CPC ..... *H01R 13/15* (2013.01); *H01R 13/24* (2013.01); *H01R 4/029* (2013.01); *H01R 13/512* (2013.01); *H01R 13/748* (2013.01)

(58) Field of Classification Search
CPC ..... H01R 13/15; H01R 13/24; H01R 13/512; H01R 13/2421; H01R 13/2428; H01R 13/2442; H01R 13/187
(Continued)

(56) References Cited

U.S. PATENT DOCUMENTS 2,718,626 A * 9/1955 Benander ..... H01R 4/4818 439/441
6,932,620 B2 * 8/2005 Ishiguro ..... H01Q 1/1271 439/66
(Continued)

FOREIGN PATENT DOCUMENTS

JP 11-307209 11/1999
JP 2003-31194 1/2003
JP 2006-19242 1/2006

OTHER PUBLICATIONS

International Search Report dated Aug. 16, 2016.

*Primary Examiner* — Tulsidas C Patel
*Assistant Examiner* — Travis Chambers
(74) *Attorney, Agent, or Firm* — Gerald E. Hespos; Michael J. Porco; Matthew T. Hespos

(57) ABSTRACT

A connector (10) includes a body portion (14), a conductive member (20) including a held portion (20A) having conductivity and held in the body portion (14), a flexible portion (20B) extending from the held portion (20A) toward a mating terminal (40) and having flexibility and a connecting portion (20C) provided on a leading end part of the flexible portion (20B) and to be connected to the mating terminal (40) by being pressed into contact with the mating terminal (40), and a spring member (60) having a spring property,
(Continued)

held in the body portion (14) and extending from the body portion (14) toward the connecting portion (20C). The spring member (60) includes a contact portion (60C) configured to give a spring property to the connecting portion (20C) by being held in contact with the connecting portion (20C).

6 Claims, 3 Drawing Sheets

(51) Int. Cl.
*H01R 13/512* (2006.01)
*H01R 4/02* (2006.01)
*H01R 13/74* (2006.01)

(58) Field of Classification Search
USPC ..... 439/289, 824, 862, 733.1
See application file for complete search history.

(56) References Cited

U.S. PATENT DOCUMENTS

| | | | | |
|---|---|---|---|---|
| 9,413,087 | B2 * | 8/2016 | Shariff | H01R 24/20 |
| 9,548,559 | B2 * | 1/2017 | Zhou | H01R 13/6205 |
| 9,887,479 | B2 * | 2/2018 | Mukuno | H01R 13/2428 |
| 2009/0236563 | A1 | 9/2009 | Goan et al. | |
| 2017/0288332 | A1 * | 10/2017 | Kato | H01R 13/2428 |

* cited by examiner

CONNECTOR WITH A SPRING TERMINAL ENSURING RELIABLE CONNECTION TO A MATING TERMINAL

BACKGROUND

Field of the Invention

This specification relates to a connector.

Description of the Related Art

Known connectors include a cantilevered spring terminal having a spring property and a body for holding the spring terminal. The spring terminal is pressed into contact with a mating terminal to connect the terminals electrically. For example, Japanese Unexamined Patent Publication No. H11-307209 discloses a connector with a contact serving as a spring terminal configured to contact and connect to an electrical component by being resiliently deformed. The contact is mounted in an insulator that defines a body. A length between a part of the spring terminal held in the body to a part of the spring terminal connected to the mating terminal must have a spring property that will ensure a sufficient contact pressure to achieve a reliable connection between the spring terminal and the mating terminal. Thus, when the spring terminal is connected to the mating terminal, i.e. during conduction, a conductive part of the spring terminal is long. As a result, a resistance of the conductive part increases and a temperature increase of the conductive part is large.

The invention was created in view of the above problem and aims to suppress a temperature increase of a conductive part during conduction.

SUMMARY

This specification is directed to a connector with a body and a conductive member. The conductive member includes a held portion, a flexible portion, a connecting portion and a spring. The held portion has conductivity and is held in the body. The flexible portion extends from the held portion toward a mating terminal and has flexibility. The connecting portion provided on a leading end part of the flexible portion and is to be connected to the mating terminal by being pressed into contact with the mating terminal. The spring has a spring property, is held in the body and extends from the body toward the connecting portion. The spring includes a contact configured to give a spring property to the connecting portion by being held in contact with the connecting portion.

The contact of the spring is held in contact with the connecting portion of the conductive member, and the spring property for pressing the connecting portion into contact with the mating terminal is given to the connecting portion by the spring member. Thus, the flexible portion need not have a spring property and can be made shorter while a sufficient contact pressure for connection reliability between the conductive member and the mating terminal is ensured. As a result, a resistance of the flexible portion during conduction can be reduced and a temperature increase of the conductive member during conduction can be suppressed.

The conductive member may be a wire that has a core is covered with a coating. The flexible portion and the connecting portion may be the core exposed from the coating of the wire. A metal plate may be fixed to a side of the core that is to be pressed into contact with the mating terminal in the connecting portion.

This can provide a specific configuration for the conductive member. Further, the connecting portion easily can be configured to contact the mating terminal by fixing the metal plate to the side of the core to be pressed into contact with the mating terminal in the connecting portion of the conductive member.

According to the this specification, it is possible to suppress a temperature increase of a conductive part during conduction.

DETAILED DESCRIPTION

An embodiment is described with reference to the drawings. In this embodiment, a motor-side connector 10 constitutes a connection device 1 for electrically connecting an unillustrated inverter and an unillustrated motor, for example, in a hybrid or electric vehicle.

Note that X, Y and Z axes orthogonal to each other are shown in some of the drawings, and each axis direction is drawn to correspond to a direction shown in each drawing. An X-axis direction coincides with a lateral direction of the motor-side connector 10 with a right side on the plane of FIG. 2 as a right side. A Y-axis direction coincides with a front-rear direction of the motor-side connector 10 with a right side on the plane of FIG. 3 as a front. A Z-axis direction coincides with a vertical direction of the motor-side connector 10 with an upper side on the planes of FIGS. 1 and 3 as an upper side.

Figure 1:
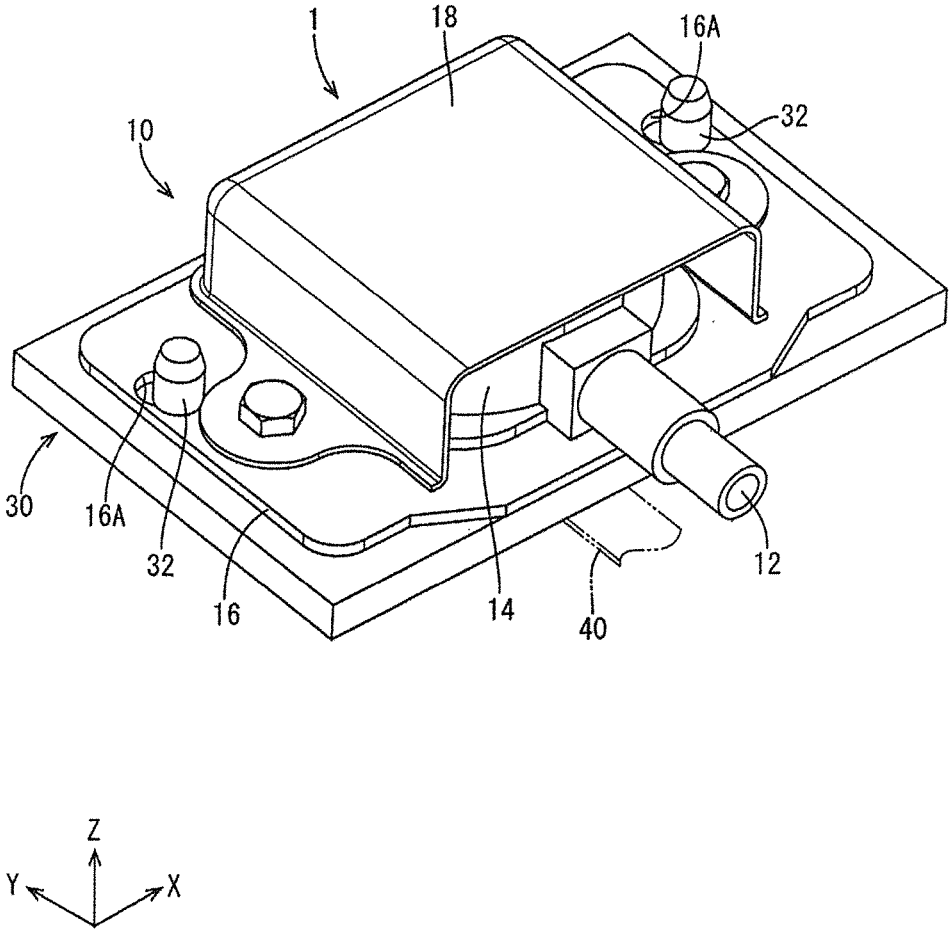
FIG. 1 is a perspective view of a connection device including a motor-side connector according to an embodiment.

First, the connection device 1 including the motor-side connector 10 of this embodiment is described. As shown in FIG. 1, the connection device 1 includes the motor-side connector 10, a wire (an example of a conductive member) 20 having one end part thereof electrically connected to a motor, an inverter-side connector 30 to be assembled with the motor-side connector 10 and an inverter-side terminal (an example of a mating terminal) 40 to be electrically connected to an inverter. Note that an upper side is a motor side and a lower side is an inverter side in each drawing.

The motor-side connector 10 is mounted on an outer surface of an unillustrated motor case for accommodating the motor, and the inverter-side connector 30 is mounted on an outer surface of an unillustrated inverter case for accommodating the inverter while facing the motor-side connector 10. The inverter-side terminal 40 extends from the inverter. More particularly, the inverter-side terminal 40 is disposed below the inverter-side connector 30 and is exposed up through a later-described inverter-side opening 30A (see FIG. 3) of the inverter-side connector 30. The connection device 1 electrically connects the wire 20 and the inverter-side terminal 40 by assembling the motor-side connector 10 and the inverter-side connector 30.

Figure 2:
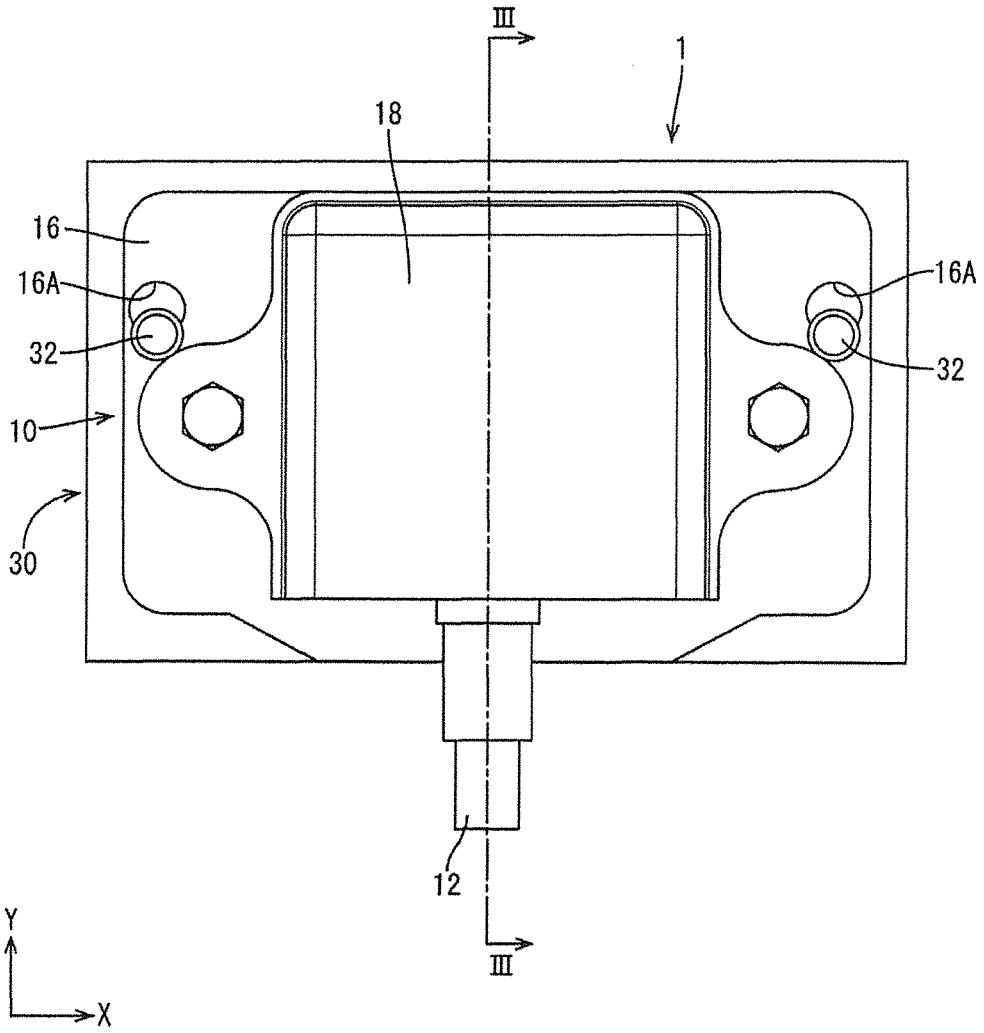
FIG. 2 is a plan view of the connection device including the motor-side connector viewed from above.

The inverter-side connector 30 is made of synthetic resin and, as shown in FIGS. 1 and 2, is a substantially flat plate. The inverter-side connector 30 is provided with the inverter-side opening 30A (see FIG. 3) open in the vertical direction.

The inverter-side opening 30A is arranged and sized so that the inverter-side terminal 40 is exposed up with the inverter-side connector 30 mounted on the inverter case.

The inverter-side terminal 40 is a rigid plate-like busbar and plate surfaces thereof extend in the front-rear direction substantially in parallel to an X-Y plane. The inverter-side terminal 40 has the one end part thereof connected to the inverter, as described above, and the other end part thereof is exposed up through the inverter-side opening 30A. Note that, the rigid inverter-side terminal 40 is difficult to deflect even if a connecting portion 20C of the wire 20 to be described later is pressed into contact therewith.

Next, the configuration of the motor-side connector 10 is described in detail. As shown in each drawing, the motor-side connector 10 is composed of a body 14 made of synthetic resin, an iron plate 16 formed of a thin iron frame plate and a cover 18 mounted on the body 14 to cover a part of the wire 20 located in a space S1 inside the body 14. The body 14 is a short tube that is open in the vertical direction. The iron plate 16 is held onto the body 14 and integrated with the body 14 by insert molding. The wire 20 is supported in the body 14 while extending in the front-rear direction.

Potbelly holes 16A vertically penetrate left and right side parts of the iron plate 16. Positioning pins 32 mounted on the inverter-side connector 30 are inserted into these potbelly holes 16A, and the iron plate 16 is slid in the front-rear direction with respect to the inverter-side connector 30 along the potbelly holes 16A from a state where the positioning pins 32 are inserted in the potbelly holes 16A, thereby being slidably locked to the inverter-side connector 30.

A mounting portion 18A to be mounted in the body 14 is provided on the inner surface (surface facing down) of the cover 18. The cover 18 has both left and right side parts thereof mounted on the body 14 by bolting, and the mounting portion 18A is mounted in an upper opening of the body 14. Note that the mounting portion 18A is held in close contact with the inner peripheral surface of the opening of the body 14 via a seal ring.

Figure 3:
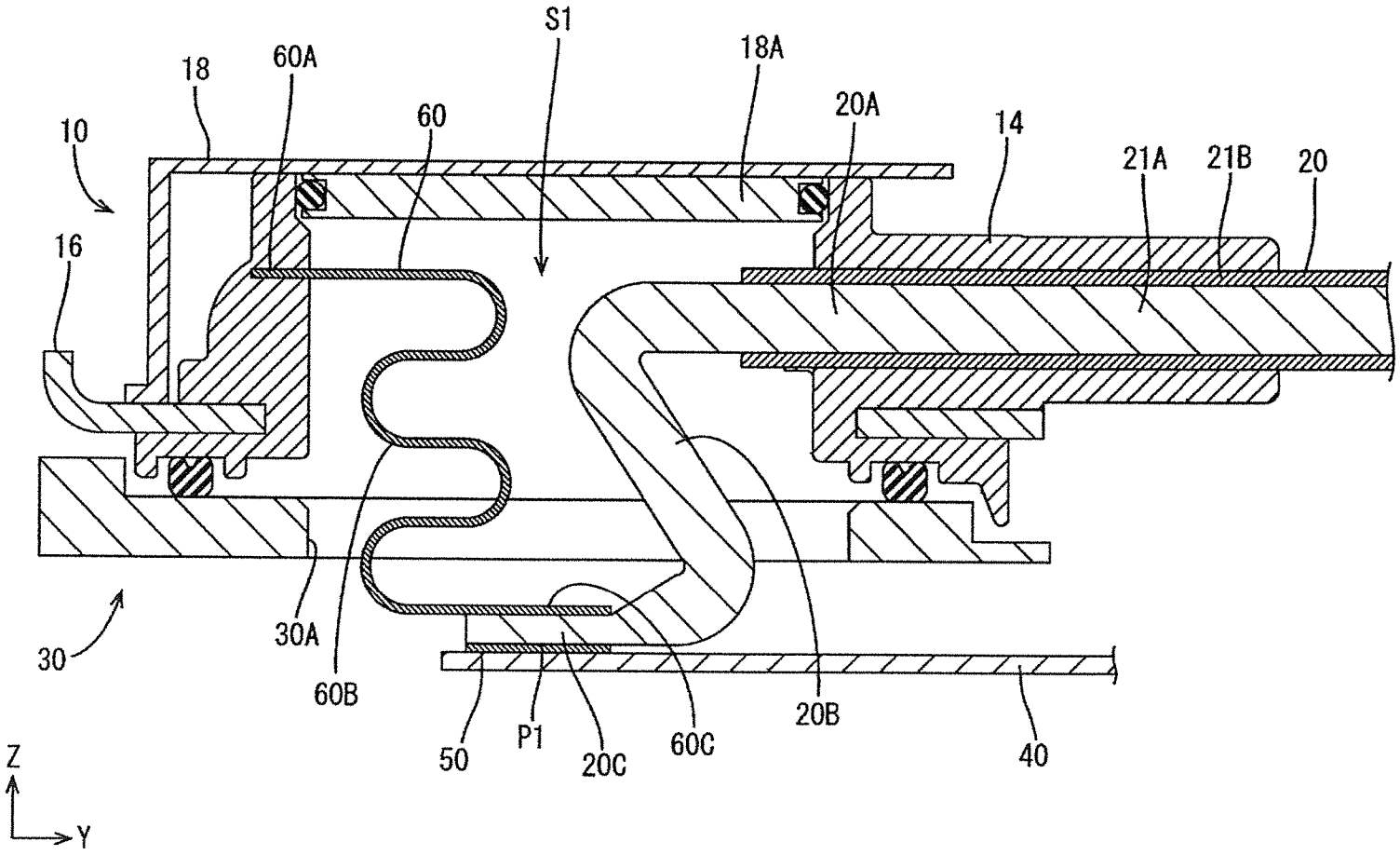
FIG. 3 is a cross-sectional view taken along of FIG. 2.

As shown in FIG. 3, the wire 20 supported in the body 14 is composed of a core 21A and an insulation coating 21B covering the core 21A. The wire 20 is embedded in a front part of the body 14 and extends to the space S1 in the body 14. The core 21A is exposed from the insulation coating 21B in a part of the wire 20 extending in the space S1 in the body 14. As shown in FIG. 3, a held portion 20A of the wire 20 is held in the body 14 by being embedded in the body 14.

The wire 20 includes a flexible portion 20B and a connecting portion 20C. The flexible portion 20B extends down from the held portion 20A toward the inverter-side terminal 40 and has flexibility. The connecting portion 20C is at a leading end of the flexible portion 20B and is to be connected to the inverter-side terminal 40 by being pressed into contact with the inverter-side terminal 40 via a metal plate 50 to be described later.

The flexible portion 20B of the wire 20 is deflected substantially in an S shape in a cross-section shown in FIG. 3, and a leading end part thereof extends to a position below the inverter-side opening 30A. The flexible portion 20B has flexibility. Thus, when the wire 20 is brought into contact with the inverter-side terminal 40, the wire 20 can be deflected due to a reaction force thereof and pressed into contact with the inverter-side terminal 40.

As shown in FIG. 3, the core 21A is solidified by plating such that both upper and lower sides are substantially flat in the connecting portion 20C of the wire 20, and a lower side of the solidified part serves as a contact point P1 to be pressed into contact with the inverter-side terminal 40. The metal plate 50 is excellent in conductivity and is fixed to the contact point P1 of the connecting portion 20C by resistance welding. A plate surface of the metal plate 50 fixed to the connecting portion 20C is substantially parallel to a plate surface of the inverter-side terminal 40. In this way, the connecting portion 20C easily contacts the inverter-side terminal 40.

A spring 60 formed of stainless steel and having a spring property is embedded in a rear part of the body 14 to correspond to the wire 20, as shown in FIG. 3. The spring 60 is formed by bending a leaf spring formed of stainless steel.

The spring 60 extends from the body 14 to the connecting portion 20C of the wire 20 in the space S1 in the body 14 and includes an embedded portion 60A, a meandering portion 60B and a contact portion 60C. The embedded portion 60A is embedded in the body 14. The meandering portion 60B extends to the connecting portion 20C of the wire 20 while meandering in the space S1 in the body 14. The contact portion 60C is configured to contact the connecting portion 20C of the wire 20 in a leading end part of the meandering portion 60B.

The contact portion 60C of the spring member 60 is in contact with the upper surface (surface on a side opposite to a side where the metal plate 50 is fixed) of the connecting portion 20C while biasing the connecting portion 20C of the wire 20 from above. In this way, a spring property is given to the connecting portion 20C of the wire 20 from the spring member 60. When the connecting portion 20C of the wire 20 is pressed into contact with the inverter-side terminal 40, a sufficient contact pressure is applied from the connecting portion 20C to the inverter-side terminal 40 to ensure connection reliability therebetween.

The contact portion 60C of the spring 60 is held in contact with the side of the connecting portion 20C of the wire 20 opposite to the side to be pressed into contact with the inverter-side terminal 40, as described above. Thus, the spring 60 gives the connecting portion 20C the spring property for pressing the connecting point 20C into contact with the inverter-side terminal 40 with a sufficient contact pressure to ensure connection reliability. Thus, the flexible portion 20B of the wire 20 need not have a spring property and a length of the flexible portion 20B can be made shorter than before. As a result, a resistance of the flexible portion 20B during conduction can be reduced and a temperature increase of the wire 20 during conduction can be suppressed.

The contact portion of the spring member is illustrated to contact the upper surface of the connecting portion of the wire in the above embodiment. However, the contact portion of the spring may directly contact the lower surface of the connecting portion of the wire, i.e. the side of the connecting portion to be pressed into contact with the inverter-side terminal or may contact this lower surface via the metal plate while biasing the connecting portion from below. In this case, if the connecting portion is biased from below by bringing the contact portion of the spring into contact with the connecting portion of the wire with the flexible portion of the wire sufficiently deflected, a spring property for pressing the connecting portion into contact with the inverter-side terminal with a sufficient contact pressure to ensure connection reliability is given to the connecting portion from the spring due to a reaction force generated in the flexible portion.

The wire in which the core is covered with the coating is illustrated as an example of the conductive member in the above embodiment. However, the conductive member is not limited. For example, the conductive member may be a braided wire. The flexible portion of the wire is illustrated to be deflected into a substantially S shape in a sectional view in the above embodiment. However, the flexible portion may extend straight from the held portion toward the connecting portion, for example, if the flexible portion has sufficient flexibility.

Although the spring is illustrated to be formed by bending the leaf spring in the above embodiment, the configuration of the spring member is not limited. For example, the spring member may be a coil spring. In this case, the spring may be held on the underside (side facing the space in the body portion) of the cover and extend down toward the connecting portion of the wire.

Although the spring is formed of stainless steel in the above embodiment, the material of the spring is not limited.

The motor-side connector is illustrated as an example of the connector in the above embodiment. However, the invention also is applicable to connectors other than motor-side connectors.

Although the embodiment and modifications have been described in detail above, these are merely illustrative and do not limit the scope of claims. A invention recited in claims includes various modifications and changes of the specific examples illustrated above.

LIST OF REFERENCE SIGNS

1 . . . connection device
10 . . . motor-side connector
14 . . . body portion
16 . . . iron plate member
18 . . . cover member
20 . . . wire
20A . . . held portion
20B . . . flexible portion
20C . . . connecting portion
30 . . . inverter-side connector
32 . . . positioning pin
40 . . . inverter-side terminal
50 . . . metal plate
60 . . . spring member
60A . . . embedded portion
60B . . . meandering portion
60C . . . contact portion
P1 . . . contact point
S1 . . . space

The invention claimed is:

1. A connector, comprising:

a body;

a wire with a conductive core including a held portion having conductivity and held in the body, a coating covering the held portion of the core, the core further having a flexible portion extending from the held portion toward a mating terminal and having flexibility, and a connecting portion provided on a leading end part of the flexible portion;

a metal plate fixed to the core at the connecting portion and being on a side of the core facing toward the mating terminal; and a spring having a spring property, the spring being held in the body and extending from the body toward the connecting portion, the spring including a contact portion held in contact with the connecting portion of the wire and thereby causing the metal plate to be pressed into contact with the mating terminal.

2. The connector of claim 1, wherein the body is made of a synthetic resin.

3. The connector of claim 2 wherein an end of the spring opposite the contact portion of the spring is embedded in the synthetic resin of the body.

4. The connector of claim 1 wherein the mating terminal is in a mating connector, the connector including a positioning plate having a portion in embedded in the body, holes being formed through portions of the positioning plate projecting from the body and receiving positioning pins of the mating connector for positioning the connector on the mating connector.

5. The connector of claim 4, further comprising a cover mounted over the body and secured to the positioning plate and the mating connector.

6. The connector of claim 5 further comprising bolts securing the cover to the positioning plate and the mating connector.

* * * * *